165-111 SR
10/22/85 OR 4,548,262

United States Patent [19]
Hull

[11] Patent Number: 4,548,262
[45] Date of Patent: Oct. 22, 1985

[54] CONDENSING GAS-TO-GAS HEAT EXCHANGER

[76] Inventor: Francis R. Hull, 23-03 45th Rd., Long Island City, N.Y. 11101

[21] Appl. No.: 654,236

[22] Filed: Sep. 25, 1984

Related U.S. Application Data

[63] Continuation-in-part of Ser. No. 480,930, Mar. 31, 1983, abandoned, which is a continuation-in-part of Ser. No. 237,909, Feb. 25, 1981, abandoned.

[51] Int. Cl.[4] ..... F28B 9/08
[52] U.S. Cl. ..... 165/111; 165/109.1; 165/134.1; 165/907; 165/913
[58] Field of Search ..... 165/109, 110, 111, 134 R, 165/134 DP, 166, DIG. 10, DIG. 18

[56] References Cited

U.S. PATENT DOCUMENTS

| | | | |
|---|---|---|---|
| 2,983,115 | 5/1961 | Caswell | 165/110 |
| 3,146,609 | 9/1964 | Engalitcheff, Jr. | 165/111 |
| 3,170,512 | 2/1965 | Smith | 165/DIG. 10 |

FOREIGN PATENT DOCUMENTS

| | | | |
|---|---|---|---|
| 968184 | 11/1950 | France | 165/166 |

*Primary Examiner*—Sheldon J. Richter

[57] ABSTRACT

Condensable fractions of a saturated gaseous stream condense onto the outer surfaces of horizontally-declined tubes of a heat exchanger. The upper wick portion of one or more elongate absorbent wicks are longitudinally disposed adjacent the lower outer surface of each horizontally-declined tube, while the lower wick appendage of each wick extends to a lower point away from the tubular heating surface. Condensate runs down the outer surfaces of the horizontally-declined tubes into interstitial passages of the absorbent wicks, and flows to their lower discharge ends. Absorbed condensate is confined to the wick drainage conduits by capillary action. Condensate flow through each wick drainage conduit is substantially accelerated by hydrostatic pressure over the average wicking distance. When its tubular heating surfaces are acid-resistant and its absorbent wicks are comprised of acid-resistant fibers or compositions coated with a surface-wetting agent, the heat exchanger may condense and separate acidous gaseous fractions from a gaseous stream. Diffuse condensable vapors in a gaseous stream passing through the heat exchanger may be electrostatically driven and concentrated as a thin film onto the heat transfer surfaces by a plurality of charged electrodes which are longitudinally disposed between horizontally-declined tube members of the condensing array.

18 Claims, 17 Drawing Figures

W.L.

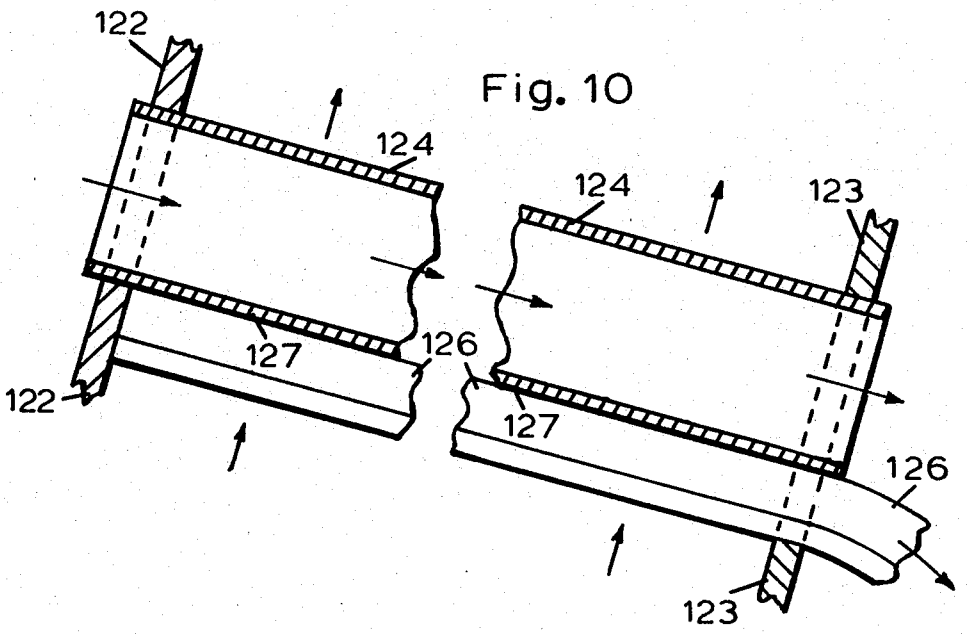
Fig. 10
Fig. 11
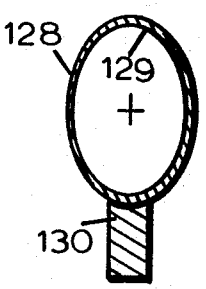
Fig. 12
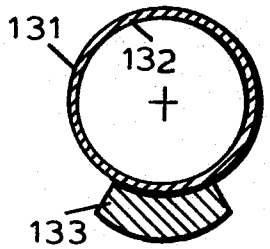
Fig. 13

CONDENSING GAS-TO-GAS HEAT EXCHANGER

The present invention is a continuation-in-part of my presently pending application Ser. No. 480,930 entitled "Condensing Gas-to-Gas Heat Exchanger" filed Mar. 31, 1983 now abandoned, which is a continuation-in-part of my prior application Ser. No. 237,909 entitled "Condensing Gas-to-Gas Heat Exchanger" filed Feb. 25, 1981, now abandoned.

This invention relates to condensing heat exchangers.

It is well known that separable gas fractions may be oxidized, chemically transformed and then condensed from hot combustion gases having appreciable water vapor content after the hot combustion gases are cooled below the dew point of the condensable gas fractions. The process may have detrimental effects as in the accelerated corrosion of conventional air preheaters and metal breechings or chimneys of boilers and steam generators, when sulfur dioxide ($SO_2$) in medium temperature flue gases is oxidized to sulfur trioxide ($SO_3$), and then chemically combined with water vapor in low-temperature flue gases to produce condensable sulfuric acid ($H_2SO_4$). However the same processes may be beneficially used in the design of energy conserving apparatus such as air preheaters for the combustion systems of boilers and steam generators, when the heat exchanger pre-heats combustion air by heat transfer from low-temperature flue gases while air polluting sulfuric acid mists ($H_2SO_4$) are condensed onto corrosion-resistant heating surfaces and removed from the flue gases before final atmospheric discharge.

While the apparatus of the invention is described in connection with both heat energy recovery and the separation of condensable gaseous pollutants from combustion gases, it will be understood by those skilled in the heat exchanger arts that variations in the heat transfer methods described hereinafter may be employed advantageously in the design of related condensing heat exchanger apparatuses without departing from the scope of the invention. As used herein:

- The term 'fluid' shall refer to any liquid or gaseous medium.
- The term 'flue gases' shall relate to the fluid stream of gaseous byproducts downstream from the combustion processes of a boiler, steam generator, or other combustion apparatus.
- The term 'air preheater' shall apply to a gas-to-gas heat exchanger which transfers heat energy from low-temperature flue gases of a combustion process to cooler incoming combustion air before the flue gases are discharged to atmosphere.
- The term 'single-pass' shall refer to a single complete passage of a fluid stream through a heat exchanger.
- The term 'two-pass' shall relate to a complete double passage of a fluid stream through a heat exchanger.
- The term 'wick' shall apply to an elongate woven fibrous braid or cellular absorbent composition which absorbs and transfers liquids from one point to another by means of capillary attraction or by hydrostatic pressure effects.
- The term 'wicking distance' shall refer to the projected vertical distance between higher and lower levels of a wicking system over which hydrostatic pressure effects complement the forces of capillary attraction to accelerate the passage of absorbed liquids.

The primary object of the invention is to provide heat exchanger configurations which condense and separate acidous gas fractions from low-temperature flue gases of boilers or steam generators without the corrosive deterioration of heat transfer surfaces.

Another important object is to provide combined energy recovery and air pollution control means which separate acidous gases and vapors from flue gases of boilers, steam generators and furnaces of any size or capacity.

Still another object is to provide combined energy recovery and air pollution control apparatuses which substantially limit sulfur oxide emissions from combustion processes fired with coals or oils having variable sulfur content.

An additional object is to provide air pollution control apparatuses which may substantially limit nitrogen oxide emissions from stationary combustion processes which are fired with any combustible fuel.

A further object is to provide means for concentrating diffuse condensable vapors onto condensing heat transfer surfaces as a gaseous stream passes through a condensing heat exchanger.

With the foregoing objects in view, together with others which will appear as the description proceeds, the invention resides in the novel assembly and arrangement of condensing gas-to-gas heat exchanger elements which will be described fully in the specification, illustrated in the drawings and defined in the claims.

In the drawings:

FIG. 1 is a fragmentary partly sectional frontal elevation of a simplified form of the invention which comprises a condensing gas-to-gas heat exchanger of the cross-flow type having a single tube pass and a single shell pass, which is arranged to treat flue gases discharged from the gas outlet of a small coal-burning hand-fired firebox-type heating boiler.

FIG. 2 is a partly-sectional end elevation in simplified form of the condensing gas-to-gas heat exchanger arranged to treat boiler outlet flue gases, and taken along offset line 1—1 of FIG. 1, and also includes in simplified form a longitudinal section of a coal-burning firebox-type heating boiler having a novel flow-reversing dry-type settling chamber with a self-cleaning catalytic oxidizing lattice disposed therein to enhance oxidation of gaseous sulfur dioxide ($SO_2$) to sulfur trioxide ($SO_3$) at medium flue gas temperatures.

FIG. 10 is an enlarged longitudinal sectional view of an alternate condensing heat exchanger tube structure with a lower bonded drainage wick attached thereto.

FIG. 11 is a transverse sectional view of the condensing heat exchanger tube structure of FIG. 10.

FIG. 12 is a transverse sectional view of another alternate condensing heat exchanger tube structure with a lower bonded wick of different shape.

FIG. 13 is a transverse sectional view of another alternate condensing heat exchanger tube structure of circular section with a lower bonded wick of different shape.

Figures 1, 2, 3, 4, 5:
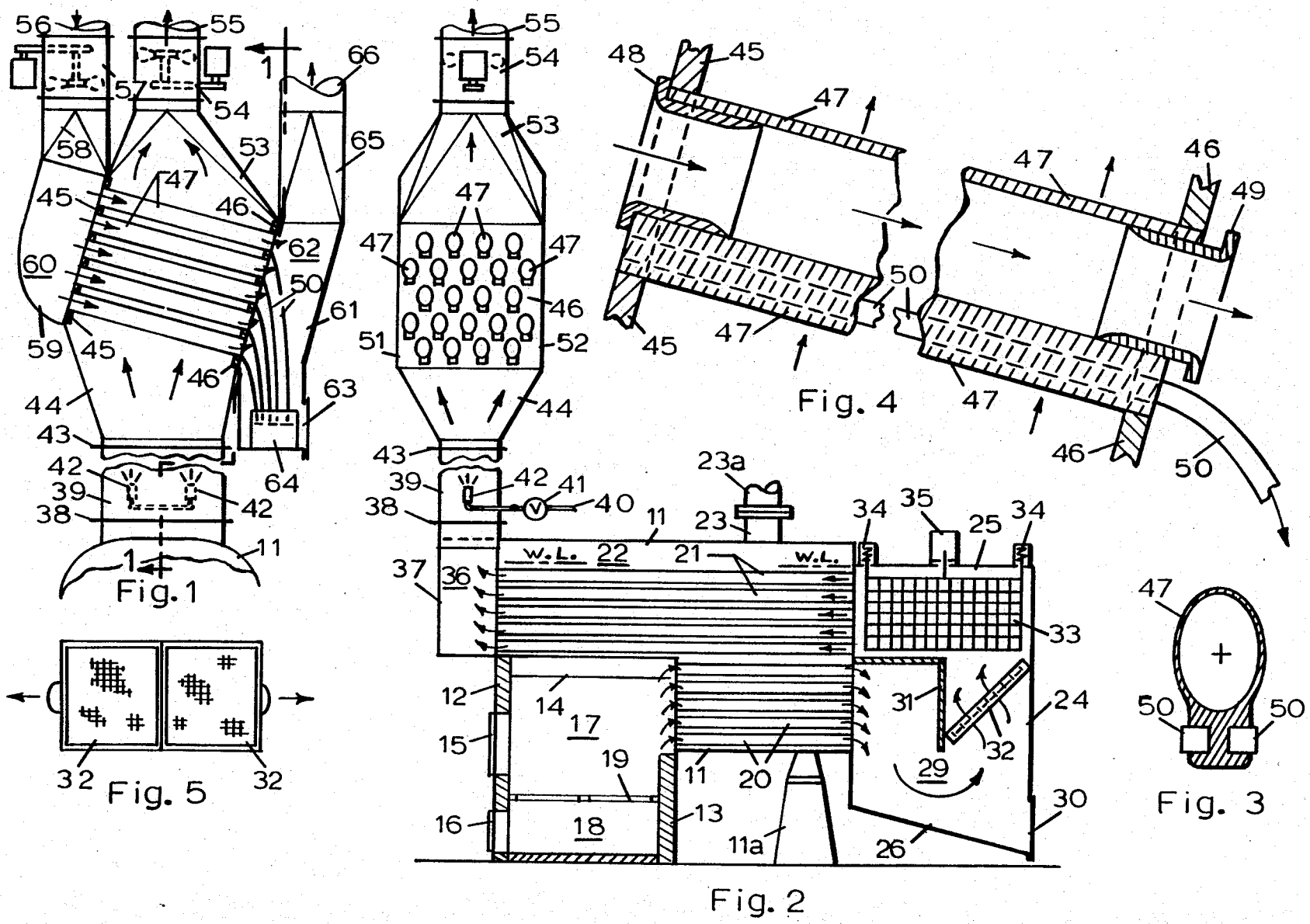
FIG. 3 is a transverse sectional view of a condensing heat exchanger tube structure which may be used in the apparatus of the invention.
FIG. 4 is an enlarged longitudinal sectional view of the condensing heat exchanger tube structure of FIG. 3.
FIG. 5 is a plan of a pair of similar slidable screen frames which are transversely disposed within the dry-type settling chamber of the apparatus of FIG. 2.

Ordinary combustion of sulfur-bearing fossil fuels such as coal or residual fuel oil in boilers, steam generators and furnaces results in oxidation of elemental sulfur contained in the fuel, liberation of about 3,984 Btu/$lb_S$ (HHV) heat energy, and release of sulfur dioxide ($SO_2$)—a noxious air pollutant whose effects are detrimental to both plant and animal life. Large tonnages of sulfur dioxide are released daily into the atmosphere within the United States by uncontrolled stationary combustion processes which burn sulfur-bearing fossil fuels. While methods for limiting sulfur dioxide emissions from stationary combustion processes are varied, effective control methods which are both economically feasible and which produce easily disposable or saleable byproducts have not been satisfactorily developed. Conventional sulfur dioxide pollution control procedures have emphasized:

(a) Limiting the sulfur content of fossil fuels before combustion, by either selective grading or other processes which reduce fuel sulfur content to an acceptable degree.

(b) Flue gas desulfurization, wherein sulfur oxides are removed from the flue gases before atmospheric discharge.

Useful economical methods for denitrifying flue gases of nitrogen oxides do not appear to have been satisfactorily developed heretofore.

The present invention teaches both flue gas desulfurization and denitrification improvements wherein suflur oxides and nitrogen oxides are chemically transformed, then removed from the flue gases by condensation as saleable or disposable acidous byproducts. Prior to the desulfurization of flue gases in the apparatus of the invention, sulfur dioxide in the flue gases is catalytically oxidized to sulfur trioxide by methods known in the chemical process arts as being effective.

In the natural processes, sulfur oxidation and transformation to sulfuric acid is commonly considered to proceed in several stages:

$$S + O_2 \rightarrow SO_2(g) + \text{heat (3,984 Btu/lb}_S\text{ HHV) Combustion} \quad (1)$$

$$2\ SO_2 + O_2\ (\text{catalyst}) \rightarrow 2\ SO_3(g)\ \text{Catalytic Oxidation} \quad (2)$$

$$SO_3 + H_2O \rightarrow H_2SO_4(g)\ \text{Hygroscopic Transformation} \quad (3)$$

In common uncontrolled combustion processes 95% or more of all fuel sulfur is discharged to atmosphere as sulfur dioxide ($SO_2$, a colorless gas), while 5% or less may be discharged as sulfur trioxide ($SO_3$) from large combustion systems. The oxidation of sulfur dioxide to sulfur trioxide is believed to be substantially caused by catalytic reactions with iron oxides formed on the internal metal surfaces of large boiler or furnace constructions, as well as through catalytic reactions with fuel-derived particulates which contain oxides of vanadium, iron and nickel. Vanadium, iron and nickel oxides are all known to be effective catalysts for accelerating the oxidation of sulfur dioxide to sulfur trioxide at favorable temperature and pressure states. It is interesting to note that small boilers and other combustion enclosures which do not have a substantial internal iron content tend to emit sulfur oxides as nearly 100% $SO_2$, and little or no significant oxidation of $SO_2$ to $SO_3$ occurs.

While chemical equilibrium strongly favors the oxidation of $SO_2$ and $SO_3$ at ambient atmospheric conditions, the reaction rate is very slow at temperatures below about 700° F. Free sulfur dioxide discharged with flue gases to atmosphere oxidizes very slowly, and also enters into photochemical reactions with other substances present in the atmosphere. Free sulfur trioxide hygroscopically combines with free atmospheric water vapor to form a condensable sulfuric acid mist or aerosol, which in small concentrations can corrode metal surfaces and attack fabrics or plant leaves. Unoxidized free sulfur dioxide, free sulfur trioxide and sulfuric acid mists or aerosols are known to causes illness or lung damage at concentrations of only 5–10 ppm, and these noxious air pollutants appear to play a combining role in the formation of photochemical smog systems.

Sulfur trioxide ($SO_3$) is the anhydride of sulfuric acid ($H_2SO_4$), and represents an intermediate energy level above chemical equilibrium in the natural environment. The chemical reaction with water is vigorous, and occurs rapidly whether either liquid or vaporous water combines with sulfur trioxide. The hygroscopic nature of sulfur trioxide is an important characteristic which can be used to desulfurize flue gases in the apparatus of the invention.

In the natural processes, nitrogen oxidation is commonly considered to proceed in several stages:

$$N_S + O_2 \rightarrow 2\ NO\ \text{Combustion} \quad (1)$$

$$2\ NO + O_2 \rightarrow 2\ NO_2\ \text{Gaseous Oxidation} \quad (2)$$

$$3\ NO_2 + H_2O \rightarrow 2\ HNO_3 + NO\ \text{Hygroscopic Transformation} \quad (3)$$

Nitrogen oxide emissions ($NO_x$) from stationary combustion systems largely result from the high-temperature chemical combination of atmospheric and fuel-derived nitrogen with oxygen in the combustion zone of fuel burning equipment. The formation of nitric oxide (NO) is substantially acclerated at flame temperatures above 3200° F. High concentrations of nitric oxide in the flue gases are typical of large utility steam generators burning fossil fuels, when a high degree of air preheating often causes elevated burner flame temperatures to approach 3800° F.

The oxidation of nitric oxide to nitrogen dioxide proceeds rapidly at temperatures near 600° F., but the reaction rate is extremely slow at ambient conditions after flue gases are discharged to atmosphere. Elevated levels of ozone are thought to be produced in atmospheric chemical reactions between nitrogen oxides and hydrocarbon vapors. Nitric acid vapors and nitrate transformation products may combine with atmospheric moisture, then fall to earth as acidic precipitation.

Nitrogen dioxide ($NO_2$) is the anhydride of nitric acid ($HNO_3$), and represents an intermediate energy level above chemical equilibrium in the natural environment. Its chemical reaction with water can be rapid, and commercial preparation of nitric acid by passing nitrogen dioxide through hot water is well known. The hygroscopic nature of nitrogen dioxide is an important characteristic which can be used to denitrify flue gases in the apparatus of the invention.

Nitrogen oxide ($NO_x$) fractions of flue gases from coal, oil or gas burners serving boilers, heaters and process equipment may also be removed by condensation in the apparatus of the invention. The excess oxygen fraction ordinarily present in combusted flue gases can substantially oxidize nitric oxide (NO) to nitrogen dioxide ($NO_2$). The nitrogen dioxide gas fraction can then hygroscopically combine with water vapor to form nitric acid ($HNO_3$) vapor, which is condensable on the tubular heating surfaces of the invention.

The illustrative embodiment of FIG. 1 is a fragmentary schematic partly-sectional frontal elevation of a heating boiler system where a condensing gas-to-gas heat exchanger of the crossflow design is arranged to limit sulfur oxide emissions from flue gases discharged from the outlet of a coal-burning hand-fired firebox-type heating boiler. This illustrative embodiment as continued in FIG. 2 shows the condensing gas-to-gas heat exchanger disposed within the flue gas ductwork downstream from the gas outlet of the heating boiler, which is schematically shown in longitudinal section.

The conventional firebox boiler structure includes steel boiler shell 11, support pedestal 11*a*, refractory-lined firebox front wall 12, refractory-lined firebox rear wall 13, refractory-lined firebox side wall 14, firing door 15, ash-pit door 16, furnace section 17, ash-pit section 18, grates 19, short horizontal firetubes 20, long horizontal firetubes 21, steam space above the boiler operating waterline 22, steam outlet 23 and exterior steam discharge pipe 23*a*.

The dry-type settling chamber 24–35 inclusive may be fabricated of steel plate or other material commonly used in the boiler fabricating arts, and is suitably secured to shell 11 of boiler 11–23 adjacent the rear tube sheet and supported by suitable floor-standing legs (not shown). The dry-type settling chamber provides rear wall 24, top panel 25, sloping bottom panel 26 with vertical panel section connecting to shell 11 of the boiler, chamber sidewalls 27 and 28, to completely enclose lower settling chamber plenum 29. Rear wall 24 provides mounting for detachable access and cleanout panel 30 adjacent its seam connection with sloping bottom panel 26, to provide means for manual removal of particulate dusts inertially separated from combustion gases flowing through the settling chamber. Transverse angular baffle 31 extends between sidewalls 27 and 28, and is disposed to channel combustion gases issuing from the outlet ends of short horizontal boiler tubes 20 downwardly towards sloping bottom panel 26 at reduced velocity and thence upwardly flowing around the lower end of baffle 31. Angularly-disposed transversely slidable screen frames 32 are housed within suitable slide frames (not shown) which extend transversely between chamber sidewalls 27 and 28. Slidable screen frames 32 may be withdrawn from their slide frames through similar slots in the sidewalls 27 and 28 of the settling chamber 24–35 to facilitate cleaning. The directions of combustion gas flow within the lower plenum 29 of the settling chamber are indicated in FIG. 2 by curved arrows from the outlet ends of short boiler tubes 20, a curved arrow around the lower end of transverse angular baffle 31, and curved arrows through the mesh of slidable screen frames 32.

Interstitial flow spaces between screening which comprises the mesh of screen frames 32 have an aggregate free area substantially less than the transverse sectional gas flow area in the fluid passage adjacent the slidable screens 32. Since the velocity of gases flowing in lower plenum 29 must substantially increase during passage thru the mesh of screen frames 32, lower plenum 29 of the settling chamber operates at a slightly higher pressure than that of the upper settling chamber section. Maintenance of a low gas flow velocity and slight pressure differential in lower plenum 29 of the settling chamber assists the inertial separation and settlement of particulates and dusts onto sloping bottom panel 26, and retards dust re-entrainment. Mesh screening and side framing of screen frames 32 is preferably fabricated of stainless steel or other material suitable for high-temperature service.

A 3-dimensional catalytic oxidizing lattice 33 is disposed within the upper section of the settling chamber on the downstream side of screen frames 32. The 3-dimensional lattice 33 may be a welded fabrication of steel rods or tubes, which is heavily coated with electrolytic iron (about 99.7% pure) or nickel. The 3-dimensional lattice 33 is freely suspended within the upper section of the settling chamber from hanger rods of vibration mountings 34, which are attached to the upper support framing of the settling chamber. Externally-actuated vibrator unit 35 is also mounted to the upper support framing of the settling chamber, and provides a suitable metal connection with the 3-dimensional lattice 33 for the transmission of mechanically induced vibrations to dislodge flue gas particulates from the lattice surfaces. Flue gas particulate deposits may also be dislodged from the surfaces of lattice 33 by soot blowing, using techniques common in the arts.

Hot combustion gases containing sulfur dioxide and excess combustion air flow over and around members of the 3-dimensional lattice 33, to heat its metal surfaces to temperatures approaching that of the combustion gases. Excess air in the hot combustion gases oxidizes the exterior metal surfaces of the 3-dimensional lattice 33 to maintain an outer coating of iron oxides (substantially $Fe_2O_3$). The exterior iron oxide coating of the 3-dimensional lattice 33 is an efficient catalyst which accelerates the oxidation of sulfur dioxide ($SO_2$) in the flue gases to sulfur trioxide ($SO_3$). The sulfur-trioxide bearing flue gases are given further treatment downstream of the boiler gas outlet to facilitate later desulfurization in the apparatus of the invention.

Hot sulfur-trioxide bearing flue gases flow past 3-dimensional lattice 33, to leave the upper section of the settling chamber. The hot gases next enter the inlet ends of long horizontal firetubes 21, as shown by the short arrows in FIG. 2. The combustion gases are substantially cooled on passage through long horizontal tubes 21 of the firebox boiler, and flow from the tube outlets into flue gas plenum 36. Flue gas outlet plenum 36 is bounded by metal walls of enclosure 37. The flanged gas outlet 38 of plenum enclosure 37 communicates with the inlet end of flue gas breeching 39.

The flue gas breeching or conduit 39 provides flanged inlet and outlet connections at 38 and 43 as shown. Breeching or conduit 39 has disposed therewithin humidifying water spray nozzles 42, which are supplied with pressurized water from an external source by way of supply pipe 40 and valve 41. The humidity of flue gases passing through breeching or conduit 39 may be controlled within operating limits by valve 41. Humidification of the flue gases may aid the hygroscopic transformation of sulfur trioxide ($SO_3$) with water vapor ($H_2O$) to form sulfuric acid vapor in the flue gas stream, which is condensable on heating surfaces of the heat exchanger invention.

The method of limiting sulfur oxide emissions by combining sulfur trioxide with water vapor to form condensable sulfuric acid vapor has important temperature control implications:

(a) Flue gases must be maintained at temperatures above their dew point upstream of the condensing heat transfer surfaces to avoid corrosive attack by sulfuric acid vapors onto surfaces of downstream equipment.

(b) Flue gases must be cooled to temperatures below their dew point to substantially remove sulfuric acid vapors by condensation onto heating surfaces of the invention.

Process control of boiler flue gas outlet temperature upstream of condensing apparatus implies means for regulating heat absorption of the boiler, since the temperature and heat content of the flue gases are functions of the difference between boiler heat release and heat absorption. Flue gas temperature entering the condensing control apparatus should always exceed but may approach the limiting dew point temperature. Methods for regulating flue gas temperatures through control of boiler heat absorption are disclosed in the following patents:

(1) U.S. Pat. No. 3,686,867 issued Aug. 29, 1972 entitled "Regenerative Rankine Cycle Power Plant", which applies principally to large stationary steam power plant systems.

(2) U.S. Pat. No. 3,934,799 issued Jan. 27, 1976 entitled "High-Capacity Steam Heating System", which applies principally to the uprating of existing stationary steam heating and process steam systems.

(3) U.S. Pat. No. 4,183,331 issued Jan. 15, 1980 entitled "Forced Circulation Steam Generator", which applies principally to the construction of package-type boiler structures and temperature control absorption exchangers of auxiliary steam generating systems.

In each of these patent disclosures, feedwater may be supplied to the boiler structure at any temperature up to saturation by regulating the quantity of recirculated heating steam which mixes with high-velocity process feedwater within water-jet ejector-type contact heat exchangers. Controlled large-scale nucleate boiling and nucleate film boiling can be induced inside the boiler structure when feedwater is injected at or near the saturation temperature.

The illustrative embodiment of FIGS. 1 and 2 discloses condensing gas-to-gas heat exchanger apparatus disposed in the flue gas discharge conduit of a common coal-burning hand-fired firebox-type steam heating boiler. This apparatus is a special form of a simple cross-flow-type heat exchanger, having one shell pass and one tube pass. Boiler flue gases from humidifying conduit 39 flow upwards into gas inlet 43 and thence towards discharge duct 55 around the outer surfaces of horizontally declined heat exchanger tubes 47 in a staggered flow pattern, while cooler outside air flows from air inlet duct 56 through the inside fluid passageways of horizontally-declined heat exchanger tubes 47 and thence towards heated air discharge duct 66. This gas-to-gas heat exchanger apparatus has potential use as a condensing air pre-heater which functions both as control equipment for limiting sulfur oxides emissions, and as energy recovery apparatus that transfers heat energy between low-temperature flue gases and incoming cold combustion air.

Hot humidified boiler flue gases enter the heat exchanger by way of flanged inlet 43, and flow through the oblique frusto-pyramidal diffuser passage bounded by the sidewalls of entrance transition 44. Entrance transition 44 is formed of sheet metal or other suitable material and communicates between flanged gas inlet 43, metal air inlet tubesheet 45, metal air outlet tubesheet 46, and heat exchanger side panels 51 and 52. A large plurality of horizontally-declined heat exchanger tubes 47 extend between corresponding perforations of air inlet tubesheet 45 and air outlet tube-sheet 46, as shown in FIGS. 1, 2 and 4. The upwardly flowing boiler flue gases flow around the outer surfaces of specially-shaped heat exchanger tubes 47, and leave the heat exchanger through the converging fluid passage formed by walls of oblique frusto-pyramidal outlet transition 53. Outlet transition 53 is formed of sheet metal or other suitable material and communicates between edges of air inlet tubesheet 45, air outlet tubesheet 46, heat exchanger side panels 51 and 52, and the circular flanged inlet of axial-type propeller exhaust fan 54. Cooled boiler flue gases flow into the inlet of exhaust fan 54, and are discharged from the system to atmosphere by way of discharge duct 55.

Cool fresh air at ambient pressure and temperature enters air supply duct 56 from a suitable outside air intake and flows into the inlet of axial-type propeller supply fan 57. The entering cool air stream is slightly pressurized by air supply fan 57 and discharged into heat exchanger air inlet plenum 60 by way of fan outlet transition 58 and the bounding walls of plenum enclosure 59. Air inlet plenum enclosure 59 communicates between the outlet of supply fan transition 58 and the edges of air inlet tubesheet 45 to enclose air inlet plenum 60. Slightly pressurized inlet air is distributed from inlet plenum 60 and flows into the inlets of the plurality of inside fluid passageways formed by the walls of heat exchanger tubes 47. Each of heat exchanger tubes 47 has similar faired or flared annular inlet-and-outlet inserts 48 and 49, which may be fabricated of any suitable material. The separate air streams flowing within the tubes 47 are heated in forced convection by heat energy transferred from the hot flue gases through the tube sidewalls. Heated air flows from the faired annular outlet inserts 49 of tubes 47 into air outlet plenum 62, which is bounded by the walls of outlet plenum enclosure 61. Outlet plenum enclosure 61 communicates with edges of outlet tubesheet 46 and the inlet edges of outlet transition 65. Air outlet transition 65 communicates between the outlet edges of plenum enclosure 61 and the inlet edges of heated air discharge duct 66. Heated combustion air from air discharge duct 66 may be supplied directly to furnace 17 above grates 19 and to ash pit 18 below grates 19 of the boiler, through suitable conduits as practiced in the arts. Heated combustion air from discharge duct 66 may also be indirectly supplied to the boiler by discharging into the boiler room enclosure, and the pre-heated combustion air may then be admitted into furnace 17 and ash pit 18 from the room by way of common adjustable registers.

A suitable tubular cross section is shown in FIG. 3, and an enlarged fragmentary longitudinal section of a horizontally-declined tube is shown in FIG. 4. The lower enlarged shank of each heat transfer tube 47 has parallel opposite rectangular channels extending over the full tubular length in this embodiment, to provide housing slots for braided or woven fiberglass wicks 50. The exterior appendages of wicks 50 extend beyond the lower ends of tubes 47 to communicate with acid storage container 64 within air outlet plenum 62. Detachable access panel 63 of outlet plenum enclosure 61 provides access to the collected acidous condensate within container 64.

Ordinary glass fibers can be braided or woven into any common fibrous weave, but untreated glass fibers will not sponge up or absorb liquids by capillary attraction. Glass fibers which have been coated with surface wetting agents to absorb aqueous solutions and then woven into wicks or assembled into fibrous pads have demonstrated capillarity. When the fibers of fiberglass wicks 50 are coated with an appropriate surface wetting agent, the forces of capillary attraction will confine acidous condensate which is absorbed through the exposed wick surfaces and permit drainage of the absorbed condensate downwardly towards the lower wick appendage.

Aqueous solutions will ordinarily move through any fiberglass material only when the liquid is subject to a pressure differential. The average wicking distance (as defined hereinbefore) for each drainage wick 50 of the acidous condensate collection system disclosed in FIG. 1 is comprised of the vertical difference between the mid-point of its tube 47 and the lowest end of wick 50 above the condensate surface within containet 64. The hydrostatic pressure differential exerted over the average wicking distance for each fiberglass wick is the principal force which accelerates the downward flow of acidous condensate through the wick into container 64.

It is evident from the foregoing that loosely woven or braided fiberglass wicks can be used to channel aqueous solutions of acidous condensate from a higher to a lower elevation, and that the wick structures described hereinbefore comprise absorbent drainage conduits for the downward flow of acidous condensate therewithin.

Heat exchanger tubes 47 may be formed of borosilicate glass, or other suitable acid-resistant material. Borosilicate glasses have excellent resistance to acid attack, a low coefficient of thermal expansion, and are available at medium cost.

Tubes 47 may be advantageously formed of extruded aluminum when their outer surfaces are given an acid-resistant coating, such as a thermoplastic fluorocarbon resin known by the registered trademark 'Teflon'. This low-friction acid resistant coating would also enhance a slidable connection between tubes 47 and the corresponding perforations of tubesheets 45 and 46 in FIGS. 1, 2 and 4.

As the upwardly flowing humidified flue gases are cooled to temperatures below the acid dew point, droplets of acidous condensate collect on the outer surfaces of inclined tubes 47 and run into absorbent wicks 50. Flue gas flow velocities between tubes 47 are maintained below re-entrainment values, to prevent condensate recapture by the flue gases.

Figure 6:
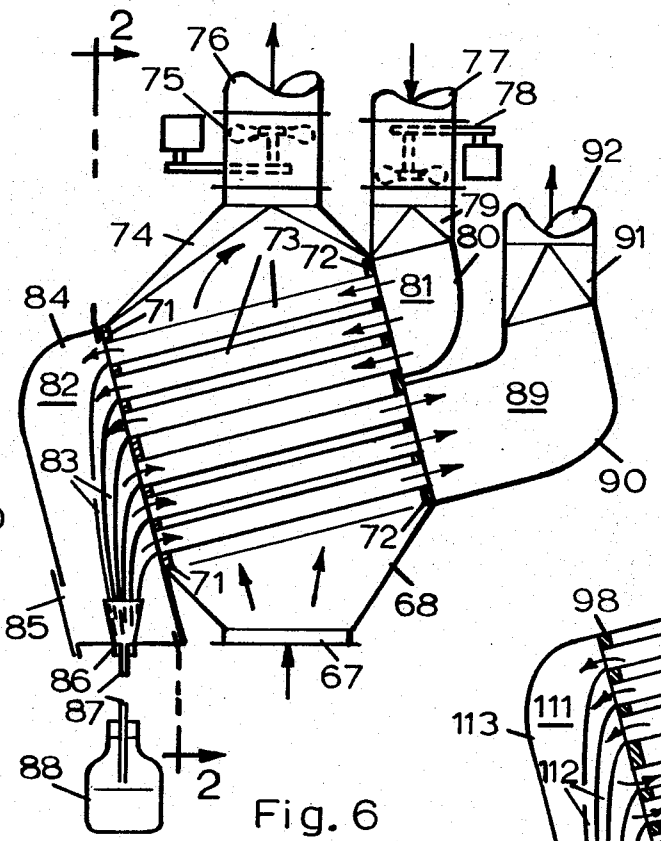
FIG. 6 is a partly-sectional frontal elevation of a condensing gas-to-gas crossflow-type heat exchanger having two tube passes and one shell pass.
Figure 7:
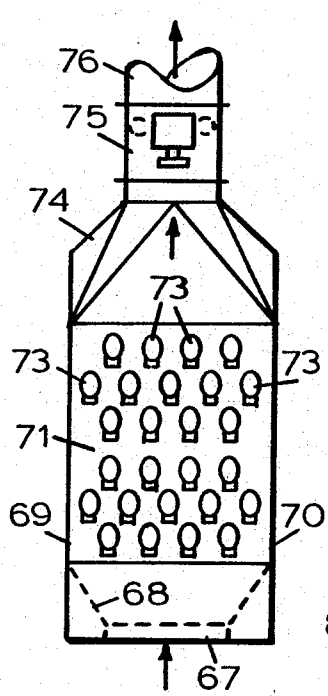
FIG. 7 is a partly sectional end elevation of the condensing two-pass crossflow-type heat exchanger of FIG. 6, and taken along offset line 2—2 thereof.
Figure 9:
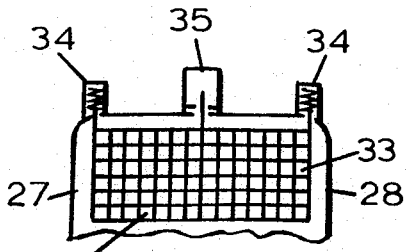
FIG. 9 is a fragmentary transverse sectional detail of the upper section of the dry-type settling chamber of FIG. 2 which shows the self-cleaning catalytic oxidizing lattice disposed therewithin in operating position.

FIGS. 6 and 7 disclose illustrative embodiments of the invention wherein hot humidified flue gases flow upwardly within the heat exchanger shell around outer surfaces of downwardly inclined tubes 73 in a two-pass counterflow pattern. Elongate drainage wicks 83 are longitudinally disposed adjacent the lower outside section of each of the tubes 73, in a pattern which may be similar to that of FIGS. 3 and 4. The large plurality of inclined tubes 73 are slidably housed in corresponding perforations of air inlet-and-outlet tubesheet 72 at the upper end and reversing plenum tubesheet 71 at the lower end. The crossflow-type heat exchanger apparatus 67–92 of FIGS. 6 and 7 can serve larger equipment with greater heat transfer effectiveness than the apparatus of FIGS. 1 and 2, although heat transfer and condensate collection processes function similarly in both apparatuses.

Hot humidified flue gases enter the heat transfer apparatus of FIGS. 6 and 7 by way of flanged inlet 67 and oblique entrance transition 68, and flows across the outer surfaces of inclined tubes 73. Inclined tubes 73 are slidably disposed between corresponding perforations of air inlet-and-outlet tubesheet 72 and reversing plenum tubesheet 71. The cooled de-humidified flue gases leave the heat exchanger by way of oblique outlet transition 74, and flow into the suction of exhaust fan 75. Exhaust fan 75 discharges the flue gases by way of duct 76.

Cool air at ambient conditions enters supply duct 77 from a suitable external intake, and flows into the suction of supply fan 78. The cool air is discharged by fan 78 through outlet transition 79 into inlet plenum 81, which is bounded by enclosure 80. The cool air flows from plenum 81 through the upper half of tubes 73, where it is partially heated, and from thence into reversing plenum 82 (bounded by enclosure 84). The partially heated air flows from reversing plenum 82 through the lower half of tubes 73 where it is further heated, and from thence into outlet plenum 89 (bounded by enclosure 90). The heated air flows from outlet plenum 89 into transition 91, and thence into discharge duct 92.

Lower appendages of acidous drainage wicks 83 within air reversing plenum 82 extend into trough 86 at the base of enclosure 84. Acidous condensate drains from wicks 83 into trough 86, and thence into exterior storage container 88 by way of conduit 87. Enclosure 84 provides service access to reversing plenum 82 by way of removable cover plate 85 as shown.

Figure 8:
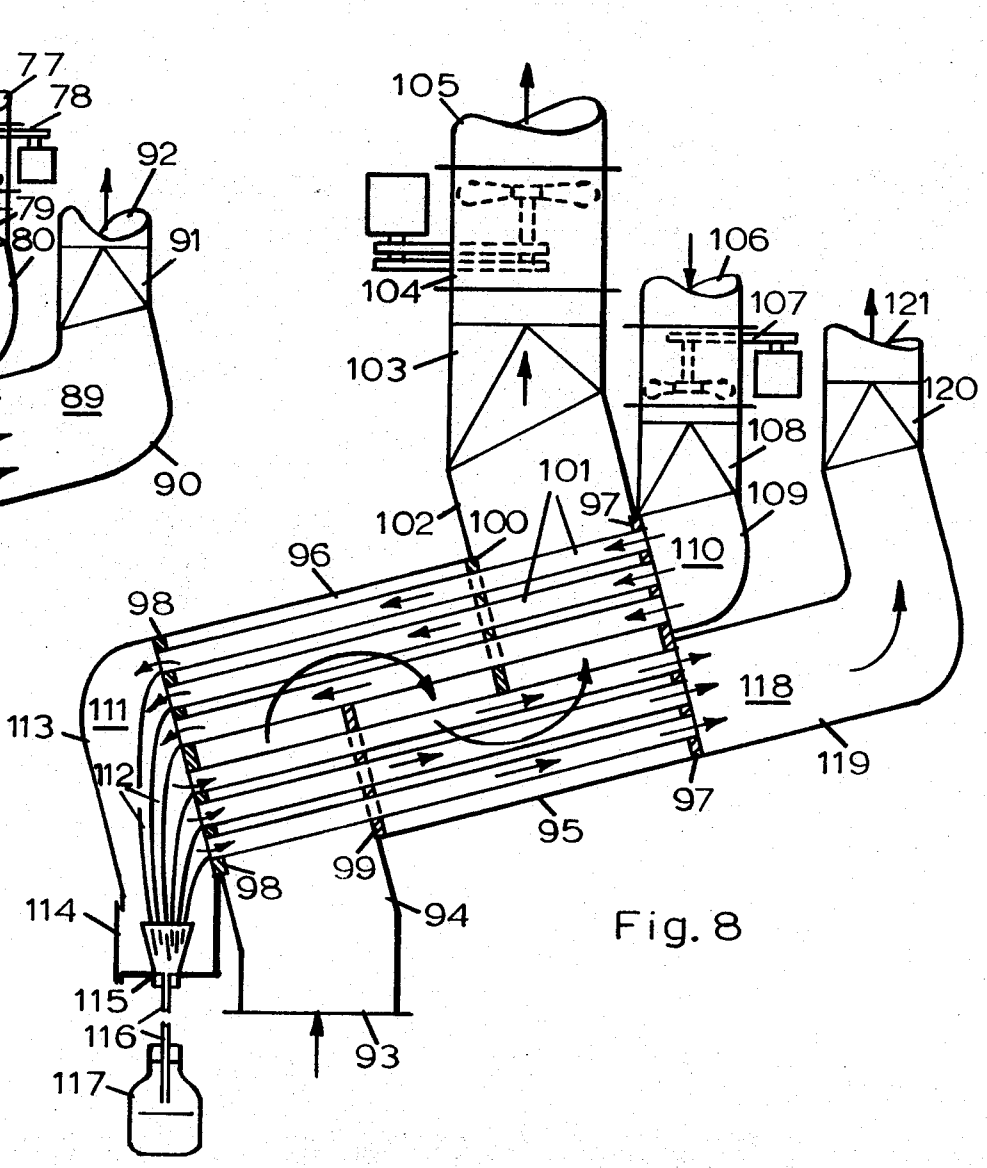
FIG. 8 is a partly-sectional longitudinal elevation is simplified form of a condensing gas-to-gas crossflow-type heat exchanger having two tube passes and three cross-baffled shell passes.

FIG. 8 discloses a shell-baffled embodiment of the invention wherein upwardly flowing hot humidified flue gases make three transverse shell passes across the outer surfaces of downwardly inclined tubes 101, while incoming air is being heated as it flows through tubes 101 in a two-pass counterflow pattern. Elongate drainage wicks 112 are longitudinally disposed adjacent the lower outside section of tubes 101, in a pattern similar to that of FIGS. 3 and 4. The large plurality of inclined tubes 101 are slidably housed in corresponding perforations of air inlet-and-outlet tubesheet 97 at the upper end and reversing plenum tubesheet 98 at the lower end, and in corresponding perforations of lower segmental transverse baffle 99 and upper segmental transverse baffle 100. The crossflow heat exchanger apparatus 93–121 of FIG. 8 can serve larger equipment with greater heat transfer effectiveness than the apparatuses of FIGS. 1 and 2 or FIGS. 6 and 7, although heat transfer and condensate collection processes function similarly in all these embodiments.

Hot humidified flue gases enter the heat transfer apparatus of FIG. 8 by way of flanged outlet 93 and oblique entrance duct 94, and make a reversing flow pass across the outer surfaces of inclined tubes 101 around the end of lower segmental transverse baffle 99. Tubes 101 are slidably disposed between corresponding perforations of air inlet-and-outlet tubesheet 97, reversing plenum tubesheet 98, lower segmental transverse baffle 99 and upper segmental transverse baffle 100. The partially cooled flue gases make a second reversing flow pass around the end of upper segmental transverse baffle 100 and across the outer surfaces of inclined tubes 101. The cooled de-humidified flue gases leave the heat exchanger by way of outlet duct 102 and oblique transition 103, and flow into the suction of exhaust fan 104. Exhaust fan 104 discharges the flue gases by way of duct 105.

Cold air at ambient conditions enters supply duct 106 from a suitable external intake, and flows into the suction of supply fan 107. The cool air is discharged by fan 107 through oblique outlet transition 108 into inlet plenum 110, which is bounded by enclosure 109. The cool air flows from plenum 110 through the upper half of tubes 101 where it is partially heated, and thence into reversing plenum 111 (bounded by enclosure 113). The partially heated air flows from reversing plenum 111 through the lower half of tubes 101 where it is further heated, and from thence into outlet plenum 118 (bounded by enclosure 119). The heated air flows from outlet plenum 118 into transition 120, and thence into discharge duct 121.

Lower appendages of acidous drainage wicks 112 within the air reversing plenum extend into trough 115, at the base of enclosure 113. Acidous condensate drains from wicks 112 into trough 115, and thence into exterior storage container 117 by way of conduit 116. Enclosure 113 provides service access to reversing plenum 111 by way of removable cover plate 114 as shown.

FIGS. 10, 11, 12 and 13 disclose tube-and-wick variations which differ from the form of FIGS. 3 and 4, wherein a single elongate absorbent wick is bonded to the lower outer surface of its inclined tube.

In FIGS. 10 and 11, an inclined elliptical tube 124 is slidably disposed between left-and-right tubesheets 122 and 123 within opposite perforations thereof. Elongate absorbent wick 126 is adhesively bonded at 127 to the lower outside surface of inclined tube 124, and the wick appendage extends beyond tubesheet 123 for the drainage transfer of collected condensate as described hereinbefore. The exposed outer surface 125 of inclined tube 124 may be covered with an acid-resistant coating, such as a fluorocarbon resin. The outer sides of wick 126 are obliquely diverging outwards from the upper tube bond 127, to assist the capture and absorption of condensate which drips downwards from the outside of tube 124. The bottom surface of wick 126 below tube 124 may be given an epoxy or other suitable impervious coating, to deflect an upwardly flow of flue gases from the absorptive sides of the wick.

FIG. 12 discloses the section of a common elliptical tube 129 whose outer surface 128 may be covered with an acid-resistant coating, such as a fluorocarbon resin. A rectangular wick 130 is adhesively bonded to the lower outer surface of tube 129. The bottom surface of wick 130 may be exposed to upwardly flowing gases, and may be given an epoxy or other impervious coating to deflect gases away from the absorbent sides of the wick.

FIG. 13 discloses the section of a common circular tube 132 whose outer surface 131 may be covered with an acid-resistant coating, such as a fluorocarbon resin. A flexible wick 133 is adhesively bonded to the lower outer surface of tube 132, so that its lower outer corners project beyond the upper inner corners of the bond. The bottom surface of wick 133 may be given an epoxy or other impervious coating to deflect upwardly flowing gases from the sides of the wick.

Condensing a diffuse vapor into a dense liquid requires a loss of heat energy, which consists of both a sensible cooling of the vapor to the condensing temperature and the latent heat of vaporization. If the vapor is diffused to a low concentration within a second gas, the total pressure of the gaseous mixture equals the sum of the pressures of the gaseous components at the temperature and volume of the mixture. Absent methods for concentrating the diffuse vapor fraction within the second gas, condensation of the diffuse vapor fraction would require cooling of the entire gaseous mixture to the condensing temperature at the partial pressure of the vapor fraction. The foregoing statement implies very large power requirements for cooling a large volume gaseous stream to the condensing temperature at the partial pressure of a diffuse vapor fraction.

Means are required for concentrating vapors in a gaseous stream, to avoid excessive power demands for condensing diffuse vapor fractions. To meet this requirement, electrostatic forces will be used in the apparatus of the invention to concentrate condensable vapors as a thin film onto the condensing heat transfer surfaces.

When gases are ionized by an electrostatic field, they become electrically conducting. Required ionizing potentials are different for each separate condensable vapor fraction of a gaseous stream, and are commonly expressed in electron volts.

A parallel array of ionizing electrode wires which is disposed in a gaseous stream may either be positively or negatively charged. Charged gas ions are repelled by and migrate away from a charging electrode, and may easily transfer the electrical charge when the gas ions collide with either solid or liquid particulates. The migration of gaseous ions away from a charging electrode may be accelerated by disposing a collector surface near the charging electrode which is either electrically grounded or given an electrical charge of opposite polarity.

A condensing gas-to-gas heat exchanger equipped with electrostatic means for concentrating condensable vapors onto its heating surfaces has many possible uses:

(a) Emissions control of process exhausts by removing condensable organic solvents, acids, hydrocarbons, etc.

(b) Chemical processes.

(c) Odor control by removing condensable olfactory irritants.

(d) De-humidification without cooling the entire process volume to temperatures below the dew point.

Figure 14:
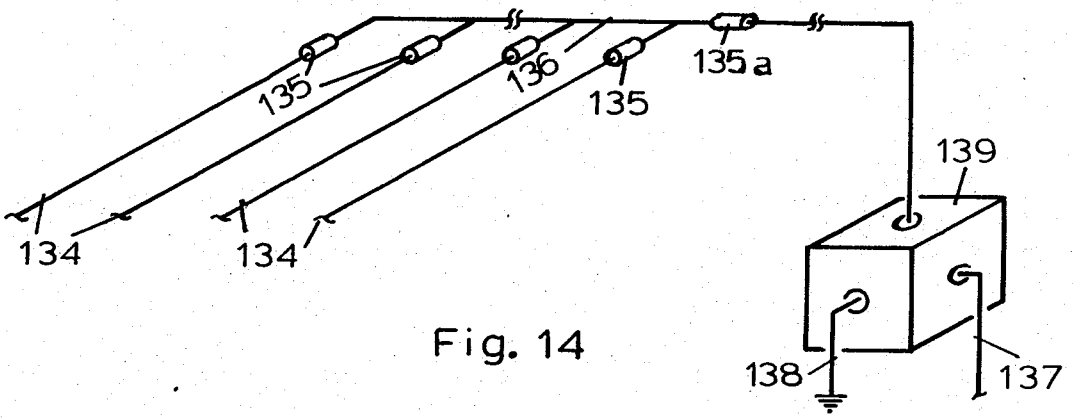
FIG. 14 is a partial isometric schematic diagram of a charged electrostatic wire assemblage, whose electrode members are disposed between heat transfer tube members to electrostatically drive condensable vapors onto the tubular heating surfaces.

FIG. 14 is a partial isometric schematic of a parallel array of charged electrode wires 134 disposed in a laterally spaced arrangement (as between tubes of a heat exchanger) which are supplied with rectified electrical current by way of common high-voltage bus or conduit 136 from exterior rectifier 139. Rectifier 139 is supplied with alternating current from a suitable source via supply conduit 137, and is connected to ground by way of conduit 138. Electrode wires 134 are provided with insulating sleeves 135 where they penetrate tubesheets, and high-voltage supply bus 136 is provided with an insulating sleeve 135*a* where the supply conduit penetrates the shell of the heat exchanger. All elements disclosed in connection with FIG. 14 are common to the electrical precipitator arts.

Figure 15:
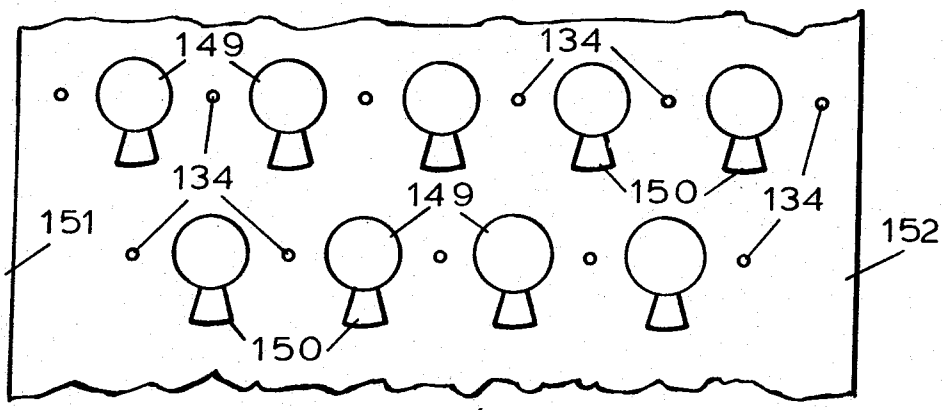
FIG. 15 is a fragmentary view of a section taken transversely to the longitudinal centerplane of the heat exchanger that shows the relative arrangement of charged electrodes and heat transfer tubes.

FIG. 15 is a fragmentary transverse section of a heat exchanger showing arrangements of charged electrode wires 134 as disposed between tubes 149, and wicks 150, the entire assemblage enclosed between sidewalls 151 and 152 of the heat exchanger. Electrode wires 134 are charged at a sufficiently high electrical potential to drive condensable vapors towards the exterior surfaces of tubes 149.

Figure 16:
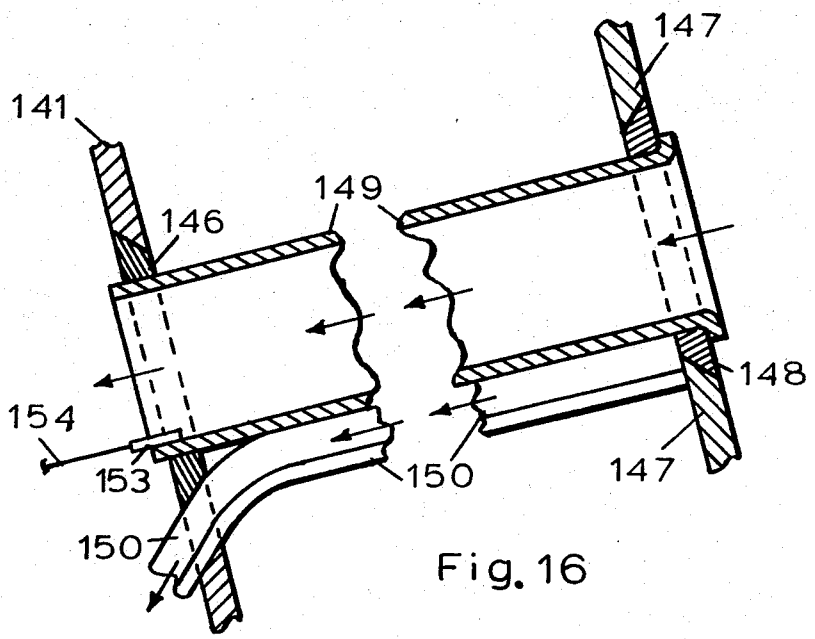
FIG. 16 is a fragmentary longitudinal sectional view of an electrically-insulated horizontally-declined heat transfer tube structure as disposed between tube sheets of a condensing heat exchanger.

FIG. 16 discloses a fragmentary longitudinal section of an electrically-insulated horizontally-declined heat transfer tube 149 disposed between opposite tubesheets 141 and 147. Elongate absorbent drainage wick 150 is adhesively bonded to the lower outer surface to tube 149. Tube 149 is housed within insulating disc 146 (which is seated in left-hand tubesheet 141), and housed within insulating disc 148 (which is seated in right-hand tubesheet 147). Absorbent drainage wick 150 penetrates the left-hand tubesheet 141 below insulating disc 146, and provides for the drainage transfer of absorbed condensate away from tube 149.

Tube 149 may be provided with an electrical connector 153, having attached electrical conductor 154 as shown. Conductor 154 may be a parallel connection to ground, as appropriate. Conductor 154 and the surface of tube 149 may alternately carry a charge of opposite polarity to that of electrode wire 134, when it is desired to further accelerate the migration of condensable vapors onto the surface of tube 149.

Figure 17:
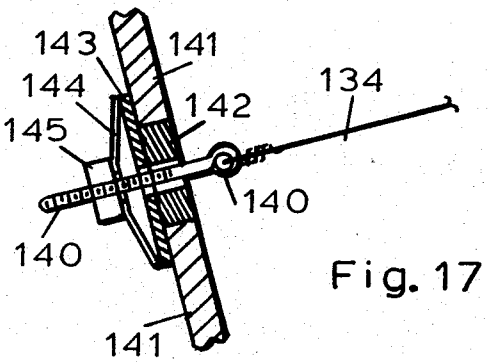
FIG. 17 is a fragmentary sectional view of an electrode wire and tube sheet connecting assembly.

FIG. 17 discloses a sectional view of a connector assembly which may be used to keep electrode wires 134 taut when they are disposed between tubes 149. Electrode wire 134 is attached to threaded eyebolt 140 as shown. Eyebolt 140 passes through a central void of insulating disc 142, which is seated within tubesheet 141. Eyebolt 140 threads into nut 145, which bears against the central area of coned-disc spring 144. Coned-disc spring 144 is disposed to bear against the insulating washer 143 at the lower outer edges of the spring, while insulating washer 143 rests against tubesheet 141. When threaded nut 145 is tightened on eyebolt 140, the tension of both coned-disc spring 144 and electrode wire 134 is increased. Electrode wire tension is then maintained by coned-disc spring 144.

From the foregoing, it will be perceived by those skilled in the art that the invention in various forms provides effective means for the separation and removal of acidous vapors from combustion gases, and the separation of condensable vapors which are diffusely concentrated in other gaseous systems.

While I have shown and described certain specific embodiments of the present invention, it will be readily understood by those skilled in the art that I do not wish to be limited exactly thereto, since various modifications may be made without departing from the scope of the invention as defined in the appended claims.

I claim:

1. A condensing heat exchanger for transferring heat between a gaseous fluid having condensable fractions and a second cooler fluid, comprising in combination: an outer shell enclosure for confining the first gaseous fluid; conduit means communicating with the said outer shell enclosure for admitting the first gaseous fluid; conduit means communicating with the said outer shell enclosure for discharging the first gaseous fluid; a plurality of vertically spaced heat transfer conduit means having vertical centerplanes and transverse centerplanes perpendicular thereto disposed and horizontally declined within the said outer shell enclosure for confining flow of the second cooler fluid through the said condensing heat exchanger; inlet and outlet conduit means communicating with the said horizontally-declined heat transfer conduit means for confining flow of the second cooler fluid into and out of the said condensing heat exchanger; absorbent drainage conduit means whose upper portion is disposed lengthwise adjacent the outer surface of each of the said horizontally-declined heat transfer conduit means below the transverse centerplane which is perpendicular to the vertical centerplane thereof, while the lower portion of each of the said absorbent drainage conduit means extends as an appendage below all of the said horizontally-declined heat transfer conduit means; whereby condensate from fractions of the first gaseous fluid which drains downwardly across the outer surface of the said horizontally-declined heat transfer conduit means is absorbed into the said absorbent drainage conduit means and confined within the said absorbent drainage conduit means by capillary action, while the condensate is impelled by hydrostatic pressure to flow downwardly through interstitial passageways of the said absorbent drainage conduit means to a lower point below all of the said horizontally-declined heat transfer conduit means.

2. The condensing heat exchanger of claim 1 wherein a plurality of absorbent drainage conduit means has upper portions which are disposed lengthwise adjacent the lower outer surface of the said horizontally-declined heat transfer conduit means, while the lower portions of the said plurality of absorbent drainage conduit means extend as appendages to a lower point below all of the said horizontally-declined heat transfer conduit means.

3. The condensing heat exchanger of claim 1 wherein a plurality of horizontally-declined heat transfer conduit means for confining flow of the second cooler fluid is disposed within the said outer shell enclosure and communicates with the said inlet and outlet conduit means; and a plurality of absorbent drainage conduit means whose upper portions are disposed lengthwise adjacent the lower outer surfaces of corresponding members of the said plurality of horizontally-declined heat transfer conduit means, while the lower portions of the said plurality of absorbent drainage conduit means each extend as appendages to a lower point below all of its respective corresponding horizontally-declined heat transfer conduit means.

4. The condensing heat exchanger of claim 1 wherein a lower longitudinal shank of the said horizontally-declined heat transfer conduit means provides one or more lengthwise channels disposed to house the upper portion of the said absorbent drainage conduit means.

5. The condensing heat exchanger of claim 1 wherein a humidifying means is disposed within the said conduit means which admits the first gaseous fluid into the said outer shell enclosure; and valve regulating means in a supply conduit of the said humidifying means for controlling the addition of moisture to the first gaseous fluid.

6. The condensing heat exchanger of claim 1 wherein the upper portion of the said absorbent drainage conduit means is disposed lengthwise vertically adjacent the lowest outer surface of the said horizontally-declined heat transfer conduit means, while the lower portion of the said absorbent drainage conduit means extends as an appendage to a lower point below all of the said horizontally-declined heat transfer conduit means.

7. The condensing heat exchanger of claim 1 wherein gaseous electrostatic ionizing means are disposed therewithin; the said gaseous electrostatic ionizing means comprising a plurality of charged elongate electrical conductors whose individual conductor members are disposed longitudinally in a spaced alternate array between the tubesheets and horizontally-declined heat transfer conduit means of the said condensing heat exchanger; and an exterior source of direct electrical current communicating with the said plurality of elongate electrical conductors of the said gaseous ionizing means; whereby condensable vapor fractions of the first gaseous fluid become ionized on flowing past the charged elongate electrical conductors of the said gaseous ionizing means, and the ionized condensable vapor fraction of the first gaseous fluid is repelled by the said elongate electrical conductors of the said gaseous ionizing means and driven onto adjacent surfaces of the said horizontally-declined heat transfer conduit means.

8. The condensing heat exchanger of claim 1 wherein gaseous electrostatic ionizing means are disposed therewithin; the said gaseous electrostatic ionizing means comprising a plurality of charged elongate electrical conductors whose individual conductor members are disposed longitudinally in a spaced alternate array between the tubesheets and horizontally-declined heat transfer conduit means of the said condensing heat exchanger; an exterior source of direct electrical current communicating with the said plurality of elongate electrical conductors of the said gaseous ionizing means; insulating means to electrically isolate the said horizontally-declined heat transfer conduit means from the structure of the said condensing heat exchanger; and a plurality of elongate electrical conductors communicating between an electrical ground exterior to the said condensing heat exchanger and the said horizontally-declined heat transfer conduit means.

9. The condensing heat exchanger of claim 1 wherein gaseous electrostatic ionizing means are disposed therewithin; the said gaseous electrostatic ionizing means comprising a plurality of charged elongate electrical conductors whose individual conductor members are disposed longitudinally in a spaced alternate array between the tubesheet and horizontally-declined heat transfer conduit means of the said condensing heat exchanger; an exterior source of direct electrical current communicating with the said plurality of elongate electrical conductors of the said gaseous ionizing means; insulating means to electrically isolate the said horizontally-declined heat transfer conduit means from the structure of the said condensing heat exchanger; an exterior second source of direct electrical current having opposite polarity from the said first exterior source of direct electrical current; and a plurality of elongate electrical conductors communicating between the said horizontally-declined heat transfer conduit means and the said exterior second source of direct electrical current.

10. A condensing heat exchanger for transferring heat between a gaseous fluid having condensable fractions and a second cooler fluid, comprising in combination: an outer shell enclosure for confining the first gaseous fluid; conduit means communicating with the said outer shell enclosure for admitting the first gaseous fluid; conduit means communicating with the said outer shell enclosure for discharging the first gaseous fluid; a plurality of vertically spaced heat transfer conduit means having vertical centerplanes and transverse centerplanes perpendicular thereto disposed and horizontally declined within the said outer shell enclosure for confining flow of the second cooler fluid through the said heat exchanger; inlet and outlet conduit means communicating with the said horizontally-declined heat transfer conduit means for confining flow of the second cooler fluid into and out of the said condensing heat exchanger; absorbent drainage wick conduit means whose upper portion is disposed lengthwise adjacent the outer surface of each of the said horizontally-declined heat transfer conduit means below the transverse centerplane which is perpendicular to the vertical centerplane thereof, while the lower portion of each of the said absorbent drainage wick conduit means extends as an appendage below all of the said horizontally-declined heat transfer conduit means; whereby condensate from fractions of the first gaseous fluid which drains downwardly across the outer surface of the said horizontally-declined heat transfer conduit means is absorbed into the said absorbent drainage wick conduit means and confined within the said absorbent drainage wick conduit means by capillary action, while the condensate is impelled by hydrostatic pressure to flow downwardly through interstitial passageways of the said absorbent drainage wick conduit means to a lower point below all of the said horizontally-declined heat transfer conduit means.

11. The condensing heat exchanger of claim 10 wherein a plurality of absorbent drainage wick conduit means has upper portions which are disposed lengthwise adjacent the lower outer surface of the said horizontally-declined heat transfer conduit means, while the lower portions of the said plurality of absorbent drainage wick conduit means extend as appendages to a lower point below all of the said horizontally-declined heat transfer conduit means.

12. The condensing heat exchanger of claim 10 wherein a plurality of horizontally-declined heat transfer conduit means for confining flow of the second cooler fluid are disposed within the said outer shell enclosure and communicate with the said inlet and outlet conduit means; and a plurality of absorbent drainage wick conduit means whose upper portions are disposed lengthwise adjacent the lower outer surfaces of corresponding members of the said plurality of horizontally-declined heat transfer conduit means, while the lower portions of the said plurality of absorbent drainage wick conduit means each extend as appendages to a lower point below all of their respective corresponding horizontally-declined heat transfer conduit means.

13. The condensing heat exchanger of claim 10 wherein a lower longitudinal shank of the said horizontally-declined heat transfer conduit means provide one or more lengthwise channels disposed to house the upper portion of the said absorbent drainage wick conduit means.

14. The condensing heat exchanger of claim 10 wherein a humidifying means is disposed within the said conduit means which admits the first gaseous fluid into the said outer shell enclosure; and valve regulating means in a supply conduit of the said humidifying means for controlling the addition of moisture to the first gaseous fluid.

15. The condensing heat exchanger of claim 10 wherein the upper portion of the said absorbent drainage wick conduit means is disposed lengthwise vertically adjacent the lowest outer surface of the said horizontally-declined heat transfer conduit means, while the lower portion of the said absorbent drainage wick conduit means extends as an appendage to a lower point below all of the said horizontally-declined heat transfer conduit means.

16. The condensing heat exchanger of claim 10 wherein gaseous electrostatic ionizing means are disposed therewithin; the said gaseous electrostatic ionizing means comprising a plurality of charged elongate electrical conductors whose individual conductor members are disposed longitudinally in a spaced alternate array between the tubesheets and horizontally-declined heat transfer conduit means of the said condensing heat exchanger; and an exterior source of direct electrical current communicating with the said plurality of elongate electrical conductors of the said gaseous ionizing means; whereby condensable vapor fractions of the first gaseous fluid become ionized on flowing past the charged elongate electrical conductors of the said gaseous ionizing means, and the ionized condensable vapor fraction of the first gaseous fluid is repelled by the said elongate electrical conductors of the said gaseous ionizing means and driven onto adjacent surfaces of the said horizontally-declined heat transfer conduit means.

17. The condensing heat exchanger of claim 10 wherein gaseous electrostatic ionizing means are disposed therewithin; the said gaseous electrostatic ionizing means comprising a plurality of charged elongate electrical conductors whose individual conductor members are disposed longitudinally in a spaced alternate array between the tubesheets and horizontally-declined heat transfer conduit means of the said condensing heat exchanger; an exterior source of direct electrical current communicating with the said plurality of elongate electrical conductors of the said gaseous ionizing means; insulating means to electrically isolate the said horizontally-declined heat transfer conduit means from the structure of the said condensing heat exchanger; and a plurality of elongate electrical conductors communicating between an electrical ground exterior to the said condensing heat exchanger and the said horizontally-declined heat transfer conduit means.

18. The condensing heat exchanger of claim 10 wherein gaseous electrostatic ionizing means are disposed therewithin; the said gaseous electrostatic ionizing means comprising a plurality of charged elongate electrical conductors whose individual conductor members are disposed longitudinally in a spaced alternate array between the tubesheets and horizontally-declined heat transfer conduit means of the said condensing heat exchanger; an exterior source of direct electrical current communicating with the said plurality of elongate electrical conductors of the said gaseous ionizing means; insulating means to electrically isolate the said horizontally-declined heat transfer conduit means from the structure of the said condensing heat exchanger; an exterior second source of direct electrical current having opposite polarity from the said first exterior source of direct electrical current; and a plurality of elongate electrical conductors communicating between the said horizontally-declined heat transfer conduit means and the said exterior second source of direct electrical current.

* * * * *